US005339148A

United States Patent [19]

Johnson et al.

[11] Patent Number: 5,339,148

[45] Date of Patent: Aug. 16, 1994

[54] IMAGE FORMING APPARATUS HAVING RECOIL FUSER

[75] Inventors: Kevin M. Johnson; Thomas C. Merle, both of Rochester, N.Y.

[73] Assignee: Eastman Kodak Company, Rochester, N.Y.

[21] Appl. No.: 105,099

[22] Filed: Aug. 9, 1993

Related U.S. Application Data

[63] Continuation of Ser. No. 41,366, Apr. 1, 1993, abandoned.

[51] Int. Cl.[5] ..... G03G 15/20

[52] U.S. Cl. ..... 355/290; 355/277; 355/285; 355/326

[58] Field of Search ..... 355/290, 289, 285, 282, 355/294, 295, 278, 277, 279, 326; 430/99, 33, 124

[56] References Cited

U.S. PATENT DOCUMENTS 4,992,833 2/1991 Derimiggio ..... 355/282
5,153,656 10/1992 Johnson et al. ..... 355/290
5,155,536 10/1992 Johnson et al. ..... 355/290
5,196,894 3/1993 Merle et al. ..... 355/285
5,235,393 8/1993 Merle ..... 355/290 X
5,253,021 10/1993 Aslam et al. ..... 355/285

*Primary Examiner*—A. T. Grimley
*Assistant Examiner*—Nestor R. Ramirez
*Attorney, Agent, or Firm*—Leonard W. Treash

[57] ABSTRACT

Image forming apparatus includes a fuser which has a fusing sheet for contacting the image bearing surface of a receiving sheet. The fusing sheet is attached at one end to a fusing sheet drum and at the other end to a spring for urging the fusing sheet in a first direction. The fusing sheet drum is rotatable in a first direction to allow the spring to move the fusing sheet in the first direction, which moves both the fusing sheet and the receiving sheet through a pressure nip formed by the fusing sheet drum and a pressure roller. The fusing sheet drum is rotatable in the second direction opposite the first direction for rewinding the fusing sheet on the fusing sheet drum. During the rewinding motion of the fusing sheet, the receiving sheet is separated from the fusing sheet by forcing the fusing sheet around a sharp bend.

25 Claims, 4 Drawing Sheets

IMAGE FORMING APPARATUS HAVING RECOIL FUSER

This is a continuation of application Ser. No. 08/041,366, filed Apr. 1, 1993 now abandoned.

This invention relates to image forming apparatus of the type in which a toner image is formed on a receiving sheet and the toner image is fixed to the receiving sheet by a combination of heat and pressure. Although not limited thereto, it is particularly usable with a receiving sheet having a heat softenable layer on which a high quality color toner image has been formed.

U.S. Pat. Nos. 5,119,142, granted to Swapceinski et al Jun. 2, 1992, and 5,157,447, granted to Farnand et al Oct. 20, 1992, are representative of a large number of references showing a belt type fixing device in which a receiving sheet having an unfixed toner image is fed into the nip between a roller and a roller backed hard metal belt. The belt is heated, for example, by heating the roller backing it, and the combination of heat and pressure fixes the toner image to the receiving sheet. The toner image is maintained in contact with the belt until it has cooled, at which point it is separated by moving the belt around a sharp turn. The beam strength of the receiving sheet causes it to resist the turn and separate from the belt.

In the above patents, the belt fuser is applied to fixing a high quality multicolor image formed on a heat softenable thermoplastic layer on the receiving sheet. The relatively high pressure in the nip embeds some of the toner in the heat softened thermoplastic. At the same time, the hard smooth belt surface increases the gloss of the print. The belt is cooled to reduce the temperature of the heat softenable layer and the toner to below its glass transition temperature before separation to assure separation without offset. In highest quality work, no release oils are used because such oils have a tendency to degrade the image. Thus, substantial cooling is important.

Even if the belt is continuously cooled after the nip, the cooling portion of the process has a tendency to increase the size of the apparatus. For example, if the receiving sheet is moving at the speed of the transfer portion of the apparatus when it enters the fuser, the fuser must operate at the same speed or separate itself from the transfer portion by a full sheet length. Operating the fuser at the full machine speed forces length into the belt for the cooling process.

U.S. Pat. No. 5,155,536, granted to Johnson et al Oct. 13, 1992; U.S. Pat. No. 5,153,656, granted to Johnson et al Oct. 6, 1992; and U.S. patent application Ser. No. 07/817,033, now U.S. Pat. No. 5,196,894 filed Jan. 3, 1992 to Merle et al, show approaches to solve this cooling space problem in which the belt is replaced with a fusing sheet which can be fed from a separate supply of fusing sheets into contact with the toner image on the receiving sheet. The resulting sandwich is fed between a pair of pressure members in the presence of heat to fix the image. The sandwich can be cooled after exiting the pressure nip while stationary or being moved at a slower speed than was the speed of the nip. In fact, the image can be cooled by directly contacting the sandwich with one or more heat sinks while the sandwich is stationary. Among other advantages of the fusing sheet over the belt, are that it does not have the belt tracking problems and replacement problems associated with endless belts. Further, some registration associated with the belt is necessary if the belt has a seam.

The use of fusing sheets solves the problem associated with cooling time and proximity between the fuser and the transfer portions of the apparatus. However, the fusing sheet itself requires handling. Although conventional sheet handling apparatus can be used to transport the fusing sheet, it must be reasonably registered with the receiving sheet and it requires its own recirculation path and holding area. Further, separation of the fusing sheet and receiving sheet is somewhat more difficult than is separation of the receiving sheet from an endless belt, which can be moved around a sharp turn to provide that separation.

SUMMARY OF THE INVENTION

It is an object of this invention to provide an image forming apparatus having a fuser having many of the advantages of fusing sheets but without many of the disadvantages.

These and other objects are accomplished by an image forming apparatus having means for forming a toner image on a receiving sheet. The apparatus includes a fusing sheet, means for overlaying the fusing sheet and the receiving sheet with the toner image between the sheets, means for heating the receiving sheet, pressure applying means forming a pressure nip, means for moving the fusing sheet and the heated receiving sheet through the nip in a first direction to fix the toner image to the receiving sheet, means for moving the receiving sheet and fusing sheet in a second direction opposite the first, and means for separating the receiving sheet and fusing sheet during movement of the receiving sheet and fusing sheet in the second direction.

According to a preferred embodiment, the fusing sheet has first and second ends. The second end is attached to a fusing sheet drum, which is rotatable in a first direction to move the first end of the receiving sheet in the first direction. It is then rotatable in an opposite direction to wind the fusing sheet on the drum while it pulls the fusing sheet in the second direction.

With the preferred embodiments of this invention, the benefits of a fusing sheet which can be moved through the pressure nip at normal machine speed but stopped for cooling are obtained, without requiring a mechanism for recirculating the fusing sheet after use. Further, because the fusing sheet is being actively pulled in its second direction, it can be conveniently moved around a sharp turn to separate the receiving sheet. Separation of the fusing sheet close to the pressure nip facilitates a geometry in which further post-treatment of the fusing sheet is accomplished in a path generally parallel to the operating path of the fusing sheet, which geometry lends compactness to the apparatus.

Although the invention can be used with single color images formed on plain paper or transparent receiving sheets, it is particularly usable in high quality multicolor apparatus using receiving sheets having a heat softenable outer layer. It is also particularly usable in apparatus which uses heat to transfer toner images to the heat softenable surface of such a receiving sheet.

DESCRIPTION OF THE PREFERRED EMBODIMENTS

Figure 1:
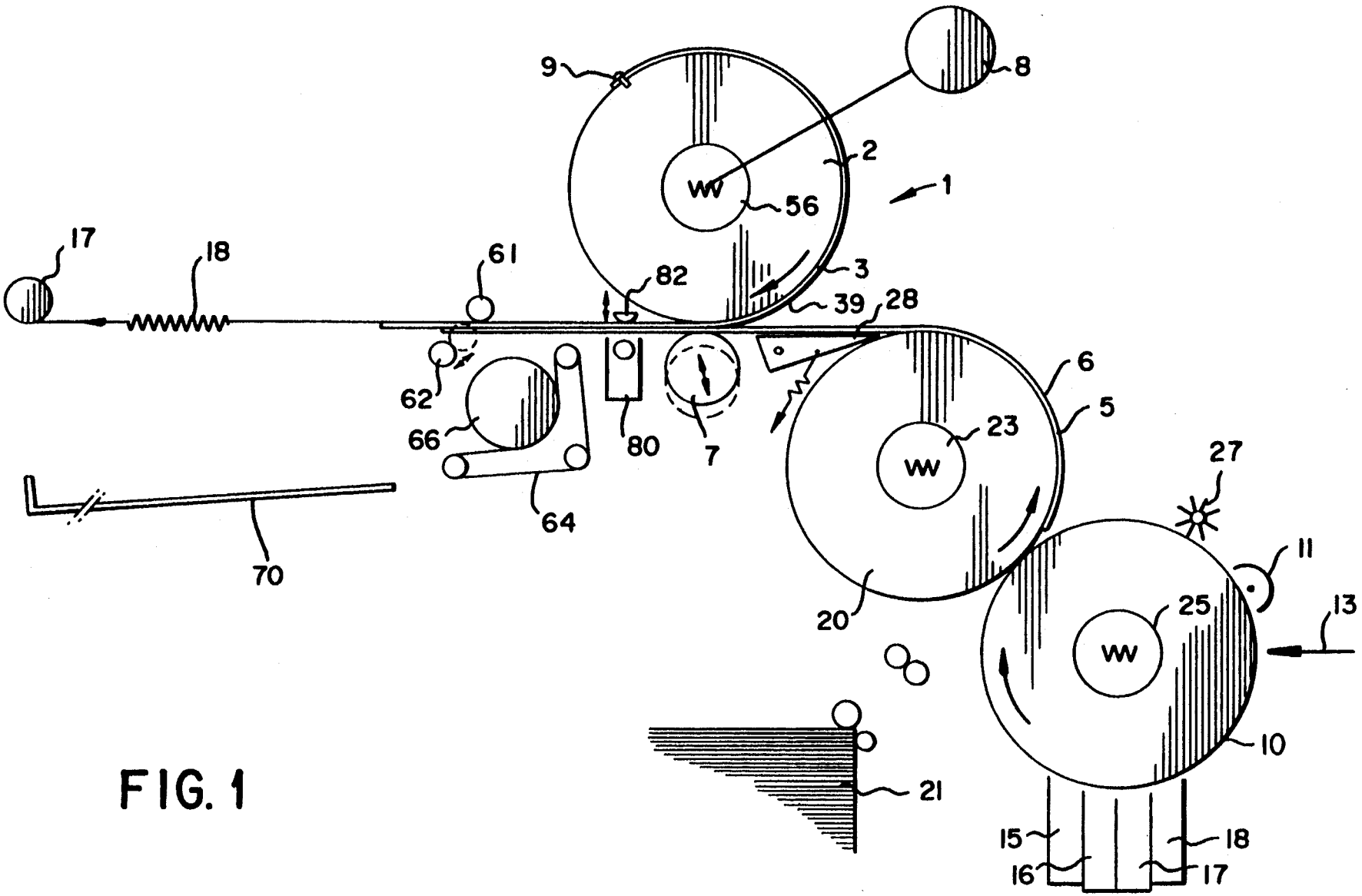
FIGS. 1 and 2 are side schematics of an image forming apparatus illustrating its operation.
Figure 2:
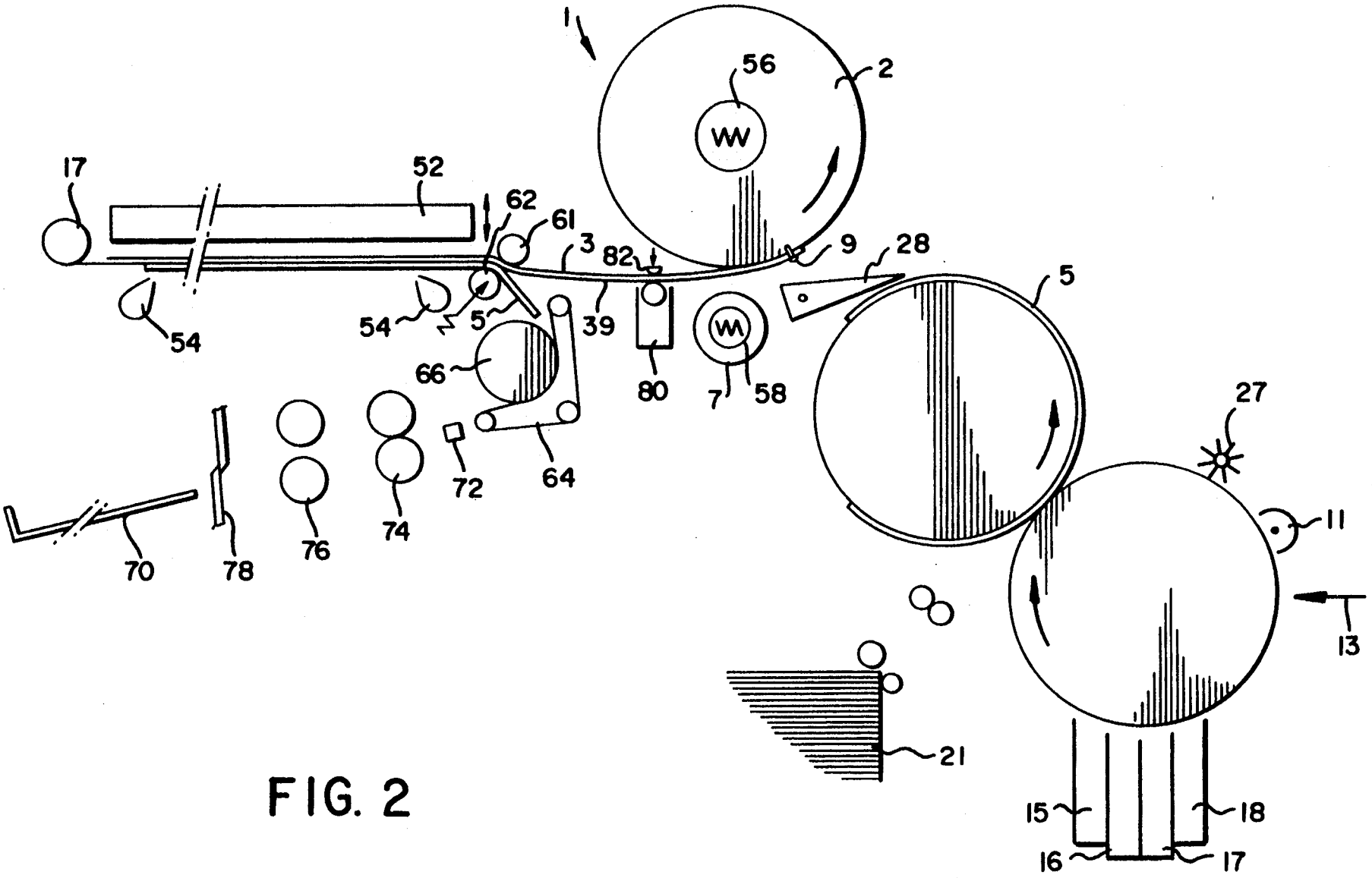

The image forming apparatus shown in FIGS. 1 and 2 includes a fuser 1 utilizing a fusing sheet 3. The image forming apparatus shown in FIGS. 3 and 4 has a fuser 30 which utilizes a fusing belt 31. Both fusers 1 and 30 cooperate with a clear toner applying station 80, but their structures are otherwise quite different. Further, both image forming apparatus are particularly designed to work with a receiving sheet 5 having a heat softenable layer which helps form a high quality image. The heat softenable layer is described in references cited above and assists in a heat transfer process which will be described in somewhat more detail and helps provide a uniformly glossy final image.

This receiving sheet with a heat softenable layer is particularly useful in making high quality color images with high gloss. However, both image forming apparatus shown in FIGS. 1 and 2 and in FIGS. 3 and 4 can also be used with single color images and they can be used on other receiving sheets such as plain paper or conventional transparency stock.

According to FIGS. 1 and 2, an image forming apparatus includes an image member, for example, a photoconductive drum 10 which is rotated to bring its outside surface through a series of stations, known in the art. The outside surface is first uniformly charged by a charger 11 and then imagewise exposed by an exposure station, for example, a laser 13 to create a series of electrostatic images. The electrostatic images are toned by the application of different color toners from a series of toning stations 15, 16, 17 and 18. Each toning station contains a different color toner and is used to tone one of the series of electrostatic images to create a series of different color toner images on image member 10.

The different color toner images are transferred in registration to an image receiving surface 6 of a receiving sheet 5 fed from a supply 21 of receiving sheets to the periphery of a transfer drum 20. The receiving sheet 5 is held to the periphery of transfer drum 20 by suitable means, for example, a vacuum, electrostatics or gripping fingers, all well known in the art.

Transfer of the toner images from image member 10 to image receiving surface 6 can be accomplished electrostatically. However, for highest quality color images, it is preferred that transfer drum 20 is heated, for example, by a heating lamp 23 to a temperature sufficient to assist in the transfer of toner from image member 10. More specifically, drum 20 is heated until receiving sheet 5 reaches a temperature which causes sintering of the toner where it touches image receiving surface 6 and also causes sintering of the toner where it touches other toner particles carried by image member 10. This sintering of the toner causes the toner particles to stick to the receiving sheet and to each other. If the image receiving surface 6 is defined by a heat softenable layer on receiving sheet 5, that heat softenable layer is softened by the heated transfer drum 20, which softening assists in the transfer of the images, especially the first image being transferred.

Image member 10 can also be heated, for example, by a lamp 25. It should only be heated to a temperature safe for its photoconductive layers, for example, 30°–40° C. To provide some width of nip for more thorough and uniform heating of the toner, a compliant backing for the photoconductive layer on image member 10 can provide that compliance without affecting heating of the receiving sheet. For good dimensional stability, a cloth backed compliant blanket used in the printing industry can be attached to a metallic drum and a photoconductive web or sheet attached to its outside surface to form image member 10.

The images are transferred in registration to the receiving sheet to create a multicolor toner image. As the last image is being transferred, a paper separating skive 28 is moved into contact with transfer drum 20 to separate receiving sheet 5 from drum 20. Receiving sheet 5 is moved by rotation of drum 20 into a nip formed by a pair of pressure members, a fusing sheet drum 2 and a fusing roller 7. A fusing sheet 3 has first and second ends. The second end is attached by a suitable attaching means 9 to the periphery of fusing sheet drum 2. Its first end is attached to a spring 18 which, in turn, is attached to a spring roller 17 gently urging fusing sheet 3 in a first direction (from right to left in FIGS. 1 and 2).

Fusing sheet 3 has a fusing surface 39 which is preferably hard and smooth. For example, it can be defined by electroformed nickel, stainless steel or other metals, metals coated with a silicone release agent or certain hard plastics such as polyethylene or polypropylene. In general, a metal belt is preferred with or without a release coating because of its hardness, smoothness and thermal conductivity. As shown in FIG. 1, fusing sheet drum 2 is rotated by a reversible motor 8 in a first, clockwise direction to cause fusing surface 39 to overlay the multicolor toner image carried by image receiving surface 6. The receiving sheet 5, fusing sheet 3 and the toner image form a sandwich which passes through the nip formed by drum 2 and roller 7 and moves in the first direction toward spring roller 17. One or both of drum 2 and roller 7 are heated to maintain the temperature of the toner image and any thermoplastic layer on receiving sheet 6 at or above their glass transition temperatures. The combination of heat and pressure in the nip fixes the toner image to the receiving sheet. It can also improve the gloss of the image and image receiving surface 6.

Note that the heating lamps 56 and 58 (FIG. 2) which heat the pressure members are helped substantially by the heating lamp 23 associated with transfer drum 20. Thus, it is possible that either or both of lamps 56 and 58 can be eliminated if there is little heat loss between the receiving sheet 6 leaving transfer drum 20 and the pressure nip. However, lamp 23 is generally closely controlled to prevent blistering of receiving sheet 6. Thus, it is usually desirable to add some heat in the pressure nip. Further, with some materials it is desirable to fix the image at a higher temperature than it is transferred. Thus, it is preferable to have some heat associated with the pressure nip in addition to that supplied by transfer heating lamp 23.

As the fusing sheet-receiving sheet sandwich moves in the first direction, the receiving sheet ultimately exits the pressure nip. At this point, rotation of fusing sheet drum 2 continues until the receiving sheet 5 passes a pair of separation rollers 61 and 62, at which point, drum 2 can be stopped and the receiving sheet 5 cooled. As shown in FIG. 2, cooling can be assisted by a variety of devices, for example, air cooling devices 54 and/or a heat sink 52. The heat sink 52 is moved into contact with the backside of fusing sheet 3 or receiving sheet 5 for a short period of time and then moved away.

When the receiving sheet is cooled sufficiently to bring the toner image and any heat softenable layer below its glass transition temperature, the fusing sheet drum 2 is rotated by motor 8 in a second, counter-clockwise direction to move the fusing sheet in a second direction, generally from left to right in FIGS. 1 and 2. A pair of separation rollers 61 and 62 are positioned on opposite sides of the sheets 3 and 5. Separation roller 62 is movable as or before the sheets move in the second direction to a position shown in FIG. 2 in which rollers 61 and 62 force the fusing sheet 3 through a sharp bend around roller 61. The beam strength of receiving sheet 5 causes receiving sheet 5 to refuse to follow fusing sheet 3 and it separates therefrom and enters a nip formed by a guide roller 66 and a guide belt 64.

Guide belt 64 and guide roller 66 are positioned to substantially reverse the movement of receiving sheet 5 and direct it back along a path from right to left, generally underneath the path that the fusing sheet takes and generally parallel to that path. This particular geometry, as shown in FIG. 2, allows further stations to be added for post-treatment of the receiving sheet while still maintaining compactness of the apparatus. For example, a reflection densitometer 72, a texturizing device 74, a backside printer 76, and a cutter 78 can all be positioned generally below the cooling portion of the fuser 1. Ultimately, the receiving sheet is deposited in a tray 70, shown after the additional stations in FIG. 2 and shown without the additional stations in FIG. 1.

Figure 3:
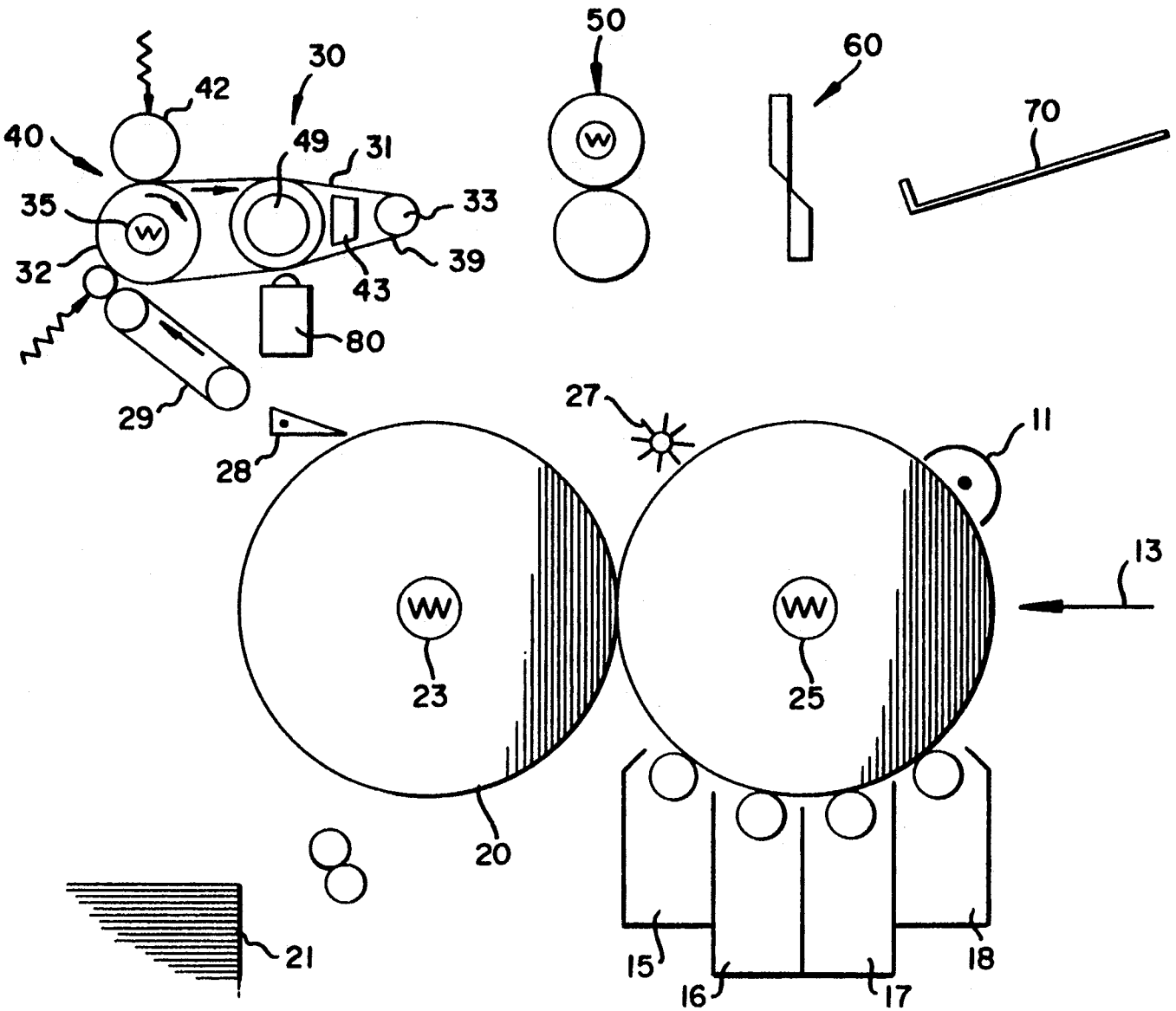
FIG. 3 is a side schematic of another image forming apparatus.
Figure 4:
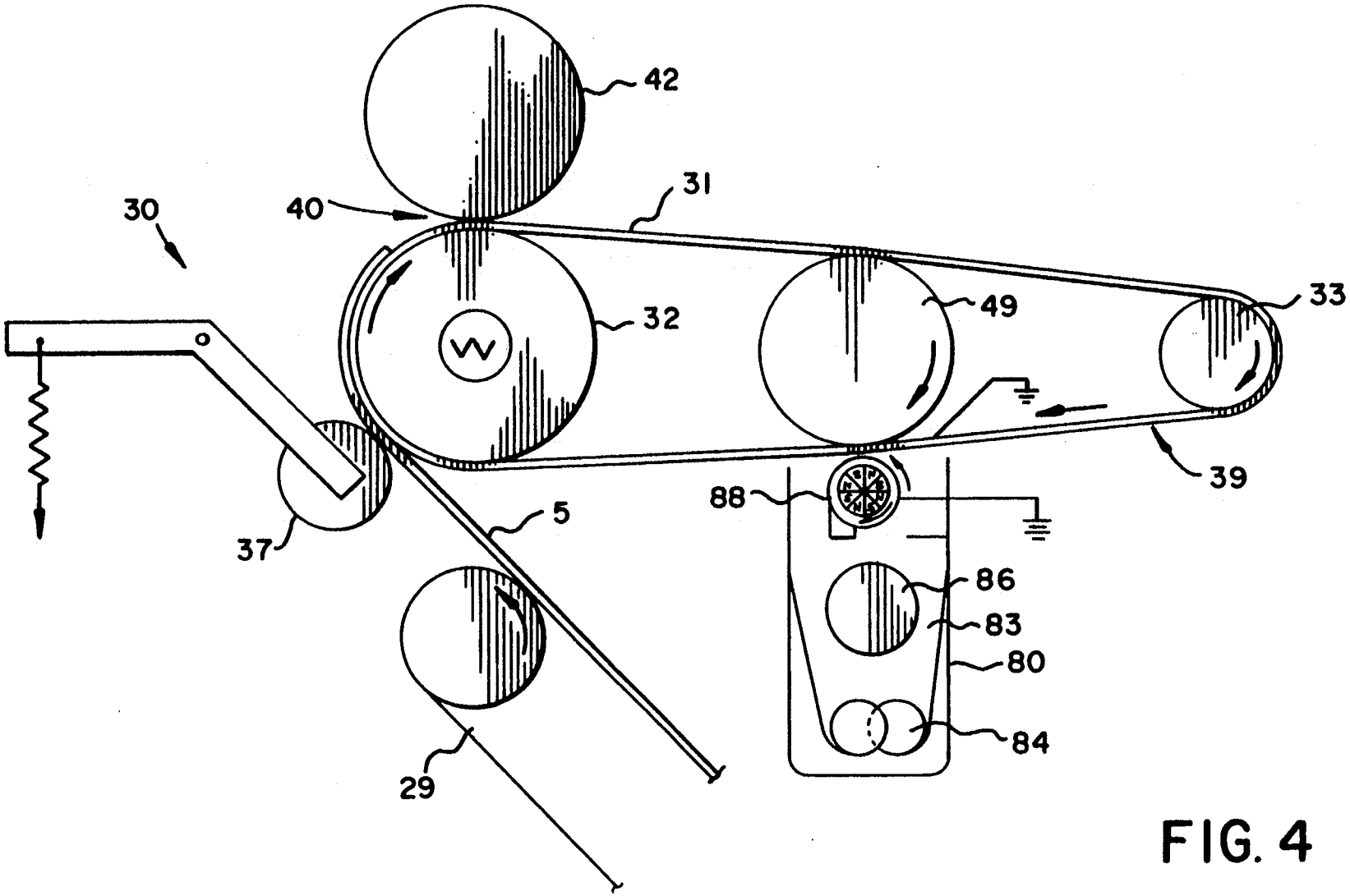
FIG. 4 is an enlarged side schematic of a portion of the image forming apparatus shown in FIG. 3.

Note that with the fuser 1, shown in FIGS. 1 and 2, the advantages of the fusing sheet are obtained with respect to providing a long cooling time while positioning the pressure nip close to the transfer station. At the same time, the necessary apparatus for recirculating the fusing sheet is eliminated, the fusing sheet always being attached to the fusing sheet drum by attaching means 9. Fuser 1 also has advantages over a belt structure (as shown in FIGS. 3 and 4), in that no belt tracking mechanism is necessary and the belt does not have to be extremely long (or move very slowly) for cooling. Further, belts are very difficult to replace, generally requiring that support rollers be cantilevered from one side of the machine. The fusing sheet shown in FIGS. 1 and 2 is easily replaced to a firmly supported fusing sheet drum 7.

FIGS. 3 and 4 show a different image forming apparatus from that shown in FIGS. 1 and 2. Multicolor images are formed on a receiving sheet 5, having a heat softenable layer, substantially as shown in FIGS. 1 and 2. However, a fuser 30 is similar to that shown in prior art U.S. Pat. Nos. 5,119,142 and 5,157,447, referred to above.

More specifically, receiving sheet 5 is transported away from transfer drum 20 by a transport mechanism 29 to fuser 30 which is shown in detail in FIG. 4. Fuser 30 includes a fusing belt 31 trained about a pair of rollers 32 and 33. Roller 32 is internally heated and roller 33 is small in diameter to assist ultimately in separation, as will be described below. Belt 31 is preferably a metal belt with a smooth hard surface and can be made of the same materials as the fusing sheet 3 described with respect to FIGS. 1 and 2. As the receiving sheet 5 approaches belt 31, it is gently pushed against belt 31 by a scuff roller 37 at a position at which the belt 31 is backed by heated roller 32. The heat from roller 32 softens the toner image and the heat softenable layer causing the receiving sheet 5 to stick to belt 31 as belt 31 proceeds around roller 32, bringing receiving sheet 5 into a nip 40 formed between roller 32, belt 31 and a pressure roller 42 which may also be heated. The image is fixed to receiving sheet 5 by the application of pressure in nip 40 while the multicolor image and thermoplastic layer are softened by the heat from roller 32.

As the receiving sheet continues on belt 31 out of nip 40, it gradually cools until it reaches small roller 33. Belt 31 is made long enough to assure that the thermoplastic layer and the toner image are both below their glass transition temperatures before reaching small roller 33. At this point, the beam strength of receiving sheet 5 separates receiving sheet 5 from belt 31 as the belt changes direction going around roller 33. Cooling of belt 31 can be aided by a heat transfer device 49 positioned between segments of belt 31 which transfers heat from the portion of the belt leaving nip 40 to the portion of the belt approaching roller 32.

Prints made using either the image forming apparatus shown in FIGS. 1 and 2 or FIGS. 3 and 4 have quite high quality and resolution and high gloss. However, such prints are vulnerable to scratches and to offset of the heat softenable layer if the prints are left in a heated environment. Toughening agents could be added to the toner and the heat softenable layer that would provide resistance to both of these effects, but such agents have an effect on the ability to create the toner images and to transfer them. They especially have a tendency to reduce the toner transfer latitude in a transfer system using heat.

This problem is solved, as best shown in FIG. 4, by applying a clear particulate material to fusing belt 31 before fusing belt 31 contacts receiving sheet 5. The clear particulate material is of a formulation that improves the scratch resistance and tendency to offset of the final image. It is melted or softened by heat from roller 32 and ultimately forms, as a clear overcoat to the image exiting nip 40.

The particulate material can be applied by any convenient mechanism that would lay down a uniform layer of toner on fusing surface 39 of belt 31. For example, the particulate material can be mixed with a magnetic carrier and applied using a conventional magnetic brush development device, as shown in FIG. 4. More specifically, particulate material applying station 80 includes a sump 83 in which the clear particulate material is mixed with the magnetic carrier by a pair of augers 84. The augers supply the mixture to a transport device 86 which transports the mixture to an applicator 88. The applicator, using a rotating magnetic core and/or a rotating shell, moves the mixture through contact with fusing surface 39 to deposit the particulate material on it. An electrical field is applied between the applicator 88 and belt 31 to assist this application. The station 80 is located at a position where the belt 31 is backed by heat exchanging device 49 to control spacing between the applicator 88 and surface 39. For more details of a station suitable for applying such clear toner, reference is made to U.S. Pat. No. 5,162,854, granted to Halbered et al on Nov. 10, 1992, which patent is incorporated by reference herein.

Referring to FIGS. 1 and 2, a clear particulate material can also be applied to the fusing sheet in fuser 1 to later transfer to the receiving sheet to protect the image. According to FIG. 1, station 80 is positioned between pressure roller 7 and guide belt 64 and opposite the path of fusing sheet 3 from a backside support 82. Backside support 82 is movable, as shown in FIG. 2, toward station 80. When fusing sheet 3 is moving in its second direction, as shown in FIG. 2, backside support 82 is moved toward station 80 to move fusing sheet 3 downward into operative relation with station 80 for receipt of the particulate material. Pressure roller 7 is moved away from fusing sheet 3 as fusing sheet is moved in its second direction.

In both embodiments, station 80 includes a transport 86 which allows the station to be turned on and off so that clear toner is not applied to the backside of receiving sheet 5 or to a portion of surface 39 that would not overlie the image on receiving sheet 5.

In the FIG. 1 and 2 embodiment, the particulate material is substantially preheated during the time the fusing sheet is wrapped on drum 2. This reduces the heat required in the nip compared to the FIG. 3 and 4 embodiments.

The clear particulate material can be of the same general formulation as some release toner compositions without their colorants, which are well known in the art. For example, various polymers which can be employed are polycarbonates, resin-modified maleic alkyd polymers, polyamides, phenol-formaldehyde polymers and various derivatives thereof, polyester condensates, modified alkyd polymers, aromatic polymers containing alternating methylene and aromatic units such as described in U.S. Pat. No. 3,809,554, and fusible cross-linked polymers are described in U.S. Pat. No. Re. 31,702. Other useful polymers include certain polycarbonates such as those described in U.S. Pat. No. 3,694,359, polymeric esters of acrylic and methacrylic acid, such as poly(alkyl acrylate), and poly(alkyl methacrylate), polyesters and copolyesters prepared from terephthalic acid moieties, a bis(hydroxyalkoxy)phenylalkane, and various styrene-containing polymers, such as those containing alkyl moieties and/or vinyl monomers other than styrene, such as, a higher alkyl acrylate or methacrylate. Examples of useful styrene-containing materials are disclosed in U.S. Pat. No. 2,917,460; U.S. Pat. No. Re. 25,316; U.S. Pat. Nos. 2,788,288; 2,638,416; 2,618,552 and 2,659,670. Especially preferred compositions comprise polymers of styrene or a derivative of styrene and an acrylate, preferably butylacrylate.

Clear particulate materials with release properties can include polymers with the addition of polymeric binder release additives or low surface energy, low molecular weight additives. The release additives even in a dispersed phase must match the refractive index of the clear material to maintain its transparency. These release additives may comprise fatty acids (for example, stearic acid, oleic acid, azelaic acid, and pellargonic acid), fatty alcohols, fatty acid esters (for example, polyvinyl stearate), metathenic soaps of fatty acids (for example, calcium stearate, and barium laurate), metallic complexes of fatty acids (for example, sodium stearate, and potassium oleate), organic complexes of silicon, hydrocarbon waxes, glycols and polyglycols. These and other release additives are all well known in the art. For example, see U.S. Pat. No. 4,464,453 for more information on toner release additives usable in this material. The preferred release additives for this invention are zinc stearate, olefin wax, octadecyl succinic anhydride and stearic acid and the most preferred method to prepare the clear release materials is by adding these release agents to a conventional colorless toner binder.

Alternatively, the clear release material can be made by modifying the polymer structure of a clear toner by the incorporation of comonomers which lower the surface energy of the clear toner. For details on making clear release materials with this release formulation, see U.S. Pat. No. 5,089,547, titled, "Cross-linked Low Surface Adhesion Additives For Toner Compositions". For example, the clear release material may comprise a silicone resin, a polyester cross-linked with a polyfunctional epoxy novolac resin or low surface energy comonomers such as isobutyl methacrylate, isopropyl methacrylate, heptafluoromethacrylate, and n-butyl methacrylate.

The clear release materials used in the process of this invention can be made by conventional melt compounding and grinding of a charge agent, binder, pigment and appropriate additive for release properties. Or, the clear release materials can be made by suspension polymerization. For details on the suspension polymerization process, see U.S. Pat. Nos. 4,965,131, 4,835,084 and 4,833,060.

The melt viscosity of this clear particulate material can be picked to provide the desired finish on the final print. For example, if the melt viscosity is low at the fusing temperature, a higher gloss would be obtained than with a higher melt viscosity. Matting agents could also be added to the particulate material to reduce the gloss of the final print. Note that using this system the $T_g$ of the clear material need not be compatible with that of the other toner for transfer purposes. Since the clear particulate material need not be capable of clean and easy transfer at the $T_g$ of the image forming toner, it may well assist fusing at a lower temperature and prevent deglossing and relief in the final image in addition to the traditional protections of an overcoat against fingerprints, offset and scratches.

The invention has been described in detail with particular reference to a preferred embodiment thereof, but it will be understood that variations and modifications can be effected within the spirit and scope of the invention as described hereinabove and as defined in the appended claims.

I claim:

1. Image forming apparatus comprising:

means for forming a toner image on a receiving sheet, a fusing sheet, means for overlaying the fusing sheet and the receiving sheet with the toner image between the sheets, means for heating the receiving sheet, pressure applying means forming a pressure nip, means for moving the fusing sheet and the heated receiving sheet through the nip in a first direction to fix the toner image to the receiving sheet, means for moving the receiving sheet and fusing sheet in a second direction opposite the first direction, and means for separating the receiving sheet and fusing sheet during movement of the receiving sheet and fusing sheet in the second direction.

2. Image forming apparatus according to claim 1 wherein said means for separating includes means for separating the receiving sheet and fusing sheet in response to movement of the fusing sheet in the second direction and said means for moving the receiving sheet in the second direction includes means for pulling the fusing sheet in the second direction.

3. Image forming apparatus according to claim 2 wherein said separating means includes means for forcing the fusing sheet to change directions sufficiently to cause the receiving sheet to separate from the fusing sheet.

4. Image forming apparatus according to claim 1 wherein said separating means includes first and second rollers having a first condition in which said rollers are in position to permit movement of the fusing sheet and receiving sheet in the first direction while said sheets maintain their overlaid condition and a second condition in which at least one of the rollers has moved to a position forcing the fusing sheet through a sufficient bend around one of said rollers to separate the receiving sheet from the fusing sheet when the fusing and receiving sheets are moved in the second direction.

5. Image forming apparatus according to claim 1 wherein said means for moving said fusing sheet in both the first and second directions is a fusing sheet drum to which an end of said fusing sheet is secured, said fusing sheet drum being rotatable in a first rotary direction to move said fusing sheet in a first direction and a second rotary direction to wind the fusing sheet around the fusing sheet drum while pulling the fusing sheet in the second direction.

6. Image forming apparatus according to claim 5 wherein said separating means includes first and second rollers having a first condition in which said rollers are in position to permit movement of the fusing sheet and receiving sheet in the first direction while said sheets maintain contact with each other and a second condition in which at least one of the rollers has moved to a position forcing the fusing sheet to bend around one of the rollers to separate the receiving sheet in response to moving the sheets in the second direction.

7. Image forming apparatus according to claim 5 wherein said means for heating the receiving sheet includes a heating means located inside the fusing sheet drum.

8. Image forming apparatus according to claim 1 wherein the means for moving the fusing sheet in the first direction includes means for moving the fusing sheet and receiving sheet in a first direction to a first position, and said apparatus includes means for directing the receiving sheet after separation from the fusing sheet through a curved path until it moves again in the first direction to a position generally parallel to the fusing sheet and receiving sheet in their first position.

9. Image forming apparatus according to claim 1 further including means for constantly urging said fusing sheet in the first direction.

10. Image forming apparatus according to claim 1 wherein said pressure applying means includes first and second pressure applying members and said heating means is located inside at least one of said pressure applying members.

11. Image forming apparatus comprising:

an image member, means for forming a series of different color toner images on said image member, means for transferring said different color toner images in registration to a receiving sheet, which transfer means includes means for moving the receiving sheet through transfer relation with each of said toner images and means for heating the receiving sheet to a temperature sufficient to transfer said images to the receiving sheet to create a multicolor image on the receiving sheet, means for separating the receiving sheet from the transfer member and for overlaying the fusing sheet with the receiving sheet with the multicolor toner image between the sheets, first and second pressure members forming a pressure nip, means for moving the fusing sheet and receiving sheet through the pressure nip in a first direction to fix the multicolor toner image to the receiving sheet, means for moving the receiving sheet and fusing sheet in a second direction opposite the first, and means for separating the receiving sheet and fusing sheet during movement of the receiving sheet and fusing sheet in the second direction.

12. Image forming apparatus according to claim 11 further including means for heating one of said pressure members to maintain said multicolor toner image at or above its glass transition temperature while said image moves through said nip.

13. Image forming apparatus according to claim 11 wherein said means for moving said sheets in both said first and second directions is a fusing sheet drum to which a first end of said fusing sheet is fastened, said fusing sheet drum being rotatable in a first rotary direction to move said fusing sheet in the first direction and a second rotary direction to wind the fusing sheet around the fusing sheet drum and pull the fusing sheet in the second direction.

14. Image forming apparatus according to claim 13 wherein said separating means includes first and second rollers having a first condition in which said rollers are in position to permit movement of the fusing sheet and receiving sheet in the first direction while said sheets maintain an overlaid condition and a second condition in which at least one of the rollers has moved to a position forcing the fusing sheet around one of the rollers through a sufficient bend to separate the receiving sheet from the fusing sheet when the fusing sheet is moved in the second direction.

15. Image forming apparatus according to claim 13 wherein the receiving sheet has a heat softenable layer having glass transition temperature such that it softens in both said transfer and fixing portions of said apparatus.

16. Image forming apparatus comprising:

means for forming a toner image on a thermoplastic layer of a receiving sheet, a fusing sheet, a fusing sheet drum rotatable in first and second opposite directions, means for fastening a second end of said fusing sheet to said fusing sheet drum, means for rotating said fusing sheet drum in a first direction to move said fusing sheet linearly in a first direction as said fusing sheet unwinds from said drum, means for overlaying said toner image on said receiving sheet with said fusing sheet as said fusing sheet is moved in its first direction and unwinds from said drum, means for applying a combination of heat and pressure forcing said sheets together as said fusing sheet and receiving sheet move in the first direction as said fusing sheet unwinds from said drum, and means for rotating said fusing sheet drum in a second direction opposite the first direction to wind the fusing sheet onto said drum.

17. Image forming apparatus according to claim 16 further including means for separating the receiving sheet from the fusing sheet in response to movement of the fusing sheet in its second direction as said fusing sheet winds onto said fusing sheet drum.

18. Image forming apparatus according to claim 16 including means for cooling said toner image and heat softenable layer after said fusing sheet has moved in its first direction but before said fusing sheet moves in its second direction.

19. Image forming apparatus according to claim 16 wherein said means for applying pressure and heat includes said fusing sheet drum.

20. Image forming apparatus according to claim 19 wherein said means for applying pressure and heat includes a source of heat located inside said fusing sheet drum.

21. Image forming apparatus according to claim 19 wherein said means for applying pressure and heat includes a pressure roller positioned to form a nip with said fusing sheet drum and said fusing sheet.

22. Image forming apparatus according to claim 16 further including spring means urging said fusing sheet in its first direction.

23. A fuser for fusing a toner image to a receiving sheet, said fuser comprising:

a fusing sheet having first and second ends and a fusing surface, a fusing sheet drum rotatable in first and second opposite directions, means for securing the second end of the fusing sheet to the fusing sheet drum, means secured to the first end of the fusing sheet for urging the fusing sheet in a first direction, said fusing sheet drum being rotatable in a first direction to permit said fusing sheet to move in said first direction under the urging of said urging means, said fusing sheet drum being movable in the second direction opposite the first direction to wind the fusing sheet onto said fusing sheet drum, and a pressure roller positionable to form a nip with said fusing sheet and fusing sheet drum for receiving a receiving sheet with the toner image of the receiving sheet in contact with the fusing surface of the fusing sheet.

24. The fuser according to claim 23 including means for heating at least one of said fusing sheet drum and said pressure roller.

25. The fuser according to claim 23 including means for separating the receiving sheet from the fusing sheet in response to movement of the fusing sheet in the second direction.

* * * * *